United States Patent [19]

Larson et al.

[11] 4,227,505

[45] Oct. 14, 1980

[54] VALVE SELECTOR CONTROL SYSTEM

[75] Inventors: Gerald L. Larson, Battle Creek; E. James Lane, Highland; Robert S. Mueller, Birmingham, all of Mich.

[73] Assignee: Eaton Corporation, Cleveland, Ohio

[21] Appl. No.: 791,493

[22] Filed: Apr. 27, 1977

[51] Int. Cl.[3] ..... F02D 13/06

[52] U.S. Cl. ..... 123/198 F; 123/90.15; 74/860

[58] Field of Search ..... 123/198 F, 32 EA, 90.11, 123/90.15, 90.16, 90.17; 74/857, 860

[56] References Cited

U.S. PATENT DOCUMENTS

| | | | |
|---|---|---|---|
| 1,797,105 | 3/1931 | Shoblom | 123/90.41 |
| 2,771,867 | 11/1956 | Peras | 123/198 F |
| 2,875,742 | 3/1959 | Dolza | 123/198 F |
| 3,645,366 | 2/1972 | Numazawa et al. | 74/860 |
| 3,710,908 | 1/1973 | Muir | 74/860 |
| 3,964,455 | 6/1976 | Brown | 123/90.16 |
| 4,040,395 | 8/1977 | Demetrescu | 123/198 F |
| 4,061,055 | 12/1977 | Iizuka et al. | 123/198 F |
| 4,098,252 | 7/1978 | Abthoff et al. | 123/198 F |
| 4,104,991 | 8/1978 | Abdoo | 123/198 F |

*Primary Examiner*—Ira S. Lazarus

*Attorney, Agent, or Firm*—Blanchard, Flynn, Thiel, Boutell & Tanis

[57] ABSTRACT

A system for optimizing the number of cylinders operating in a multicylinder engine, during ongoing engine operation. Input circuitry monitors conditions under which the engine is operating and generates corresponding input signals. Logic circuitry, based on such input signals, determines whether to then add to, subtract from, or maintain unchanged the number of cylinders operating in the engine. Output circuitry, responsive to the logic circuitry, enables and disables specific cylinders in the engine, in a preferred embodiment through valve selectors respectively provided on several cylinders of the multicylinder engine. The logic technique includes a bidirectional counting portion capable of sequential up and down counting through several steps to correspondingly sequentially enable or disable the valve selector equipped cylinders of the engine in, preferably, one cylinder steps. Preferred embodiments are directed to vehicle engines and the input circuitry preferably monitors operating parameters such as engine load, throttle position, transmission top gear selection, and engine or vehicle speed.

24 Claims, 5 Drawing Figures

VALVE SELECTOR CONTROL SYSTEM

FIELD OF THE INVENTION

This invention relates to a system for controlling enabling and disabling of operation of several cylinders in a multicylinder engine, and more particularly to such a system for stepwise increasing and decreasing the operating number of cylinders in the engine in response to sensed operating conditions.

BACKGROUND OF THE INVENTION

The present invention was developed in connection with a continuing effort to improve operating efficiency in automotive vehicle engines, particularly as to their fuel economy. Thus, while it is contemplated that the present invention, at least in its broader aspects, will be applicable to multicylinder engines of various types in various (e.g. nonvehicular) environments, the embodiments hereafter disclosed illustrate the invention applied to multicylinder, throttle controlled vehicle engines, such as conventional six and eight cylinder gasoline engines. The term "cylinder" is used broadly, usually interchangeably with "combustion chamber", and is not limited to reciprocating piston-in-cylinder engines but rather applies also to other engine types, e.g. rotary.

Conventionally, vehicles such as delivery trucks are powered by six or eight cylinder engines of sufficient size and power to adequately propel the vehicle under contemplated worst or substantially worst case operating conditions, e.g. under maximum engine load conditions as may arise from carrying full cargo up a relatively steep hill, or in accelerating from a standstill.

On the other hand, substantially less power, and engine displacement, is required under less demanding operating conditions, such as vehicle coasting or engine idle conditions, such as substantially steady state highway cruise conditions, or indeed other operating conditions needing only lesser power. It has been found that increased fuel economy can be obtained under such conditions if a substantial number of engine cylinders, i.e. combustion chambers, are rendered inoperative, as by maintaining their valves closed. Improved fuel economy has resulted in vehicle engines where half the cylinders are provided with disable-enable devices operating on the combustion chamber valves, hereafter called valve selectors, and the engine is alternatively operated on half or on all of its cylinders, for example three or six cylinders in a six cylinder engine or four or eight cylinders in an eight cylinder engine.

However, particularly in city or city-suburban driving, the amount of time the vehicle spends idling, coasting on closed throttle, or in low load, moderate speed steady state cruise may be quite limited. Instead, the vehicle may spend much of its time operating under intermediate conditions where the entire complement of cylinders (six or eight for example) is not needed, but must be kept operating because insufficient power is available in only half the complement of cylinders operating (e.g. three or four cylinders operating).

Accordingly, the objects of this invention include provision of:

A system for optimizing the number of cylinders which are operational at any given time in a multicylinder engine, in dependence on conditions under which the engine is operating.

A system as aforesaid in which cylinder enabling-disabling devices on a plurality of cylinders of a multicylinder engine need not be actuated or deactuated all at once but may be actuated or deactuated sequentially to provide for operation of the engine on a number of cylinders between minimum and maximum, so as to permit engine operation on less than all cylinders where operating conditions would not permit deactuation of all deactuable cylinders, and so as to permit, under a given set of operation conditions, a reduction in the proportion of the time spent in the all cylinders operating mode of the engine.

A system as aforesaid useable for controlling valve selectors on an engine so as to disable a given cylinder by permitting its valves to stay closed during engine operation.

A system as aforesaid particularly adapted to vehicle engines and capable of sensing vehicle parameters such as throttle setting, engine vacuum or load, engine or vehicle speed, and transmission gear engagement (e.g. third gear) and capable of selecting among several numbers of cylinders to be enabled in a manner to suit the then sensed vehicle parameters.

A system as aforesaid in which primary operation is to increase the number of operating cylinders when engine loading is high and decrease the number of operating cylinders when engine loading is lower, wherein intake manifold vacuum is used as a measure of engine loading, and wherein this primary operation is modified by other vehicle operating conditions, such as closed throttle, low or high vehicle speed, transmission gear engaged, or the like.

A system as aforesaid in which stepwise enabling and disabling of engine cylinders is carried out with bidirectional counting means.

Other objects and purposes of this invention will be apparent to persons acquainted with apparatus of this general type upon reading the following specification and inspecting the accompanying drawings.

SUMMARY OF THE INVENTION

The objects and purposes of the invention are met by providing a system for optimizing the number of cylinders operating in a multicylinder engine, during ongoing engine operation. Input circuitry monitors conditions under which the engine is operating and generates corresponding input signals. Logic circuitry, based on such input signals, determines whether to then add to, subtract from, or maintain unchanged the number of cylinders operating in the engine. Output circuitry, responsive to the logic circuitry, enables and disables specific cylinders in the engine, in a preferred embodiment through valve selectors respectively provided on several cylinders of the multicylinder engine. The logic circuitry includes a bidirectional counting portion capable of sequential up and down counting through several steps to correspondingly sequentially enable or disable the valve selector equipped cylinders of the engine in, preferably, one cylinder steps. Preferred embodiments are directed to vehicle engines and the input circuitry preferably monitors operating parameters such as engine load, throttle position, transmission top gear selection, engine or road speed and manifold vacuum.

DETAILED DESCRIPTION

Figure 1:
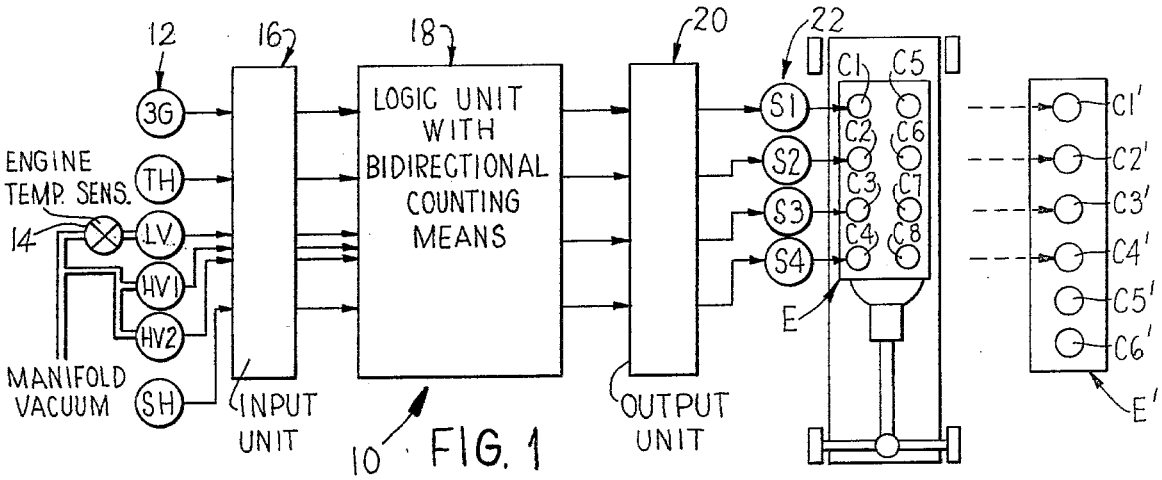
FIG. 1 is a block diagram of a preferred embodiment of the invention, as applied for example to a V-8 engine.

FIG. 1 discloses the general organization, in block diagram form, of a preferred embodiment 10 of the invention. Plural sensors generally indicated at 12 monitor engine and/or vehicle operating conditions. In the embodiment shown, a sensor 3G detects whether or not the vehicle is operating with its transmission in top (normally third) gear, or rather is in some lower gear. Alternatively, much the same purpose would be served be sensing operation below normal steady state speeds, for example below twenty-five mph (about 40 kph) or 850 rpm engine speed.

A further sensor TH monitors engine throttle position. A sensor SH detects vehicle operation above or below a relatively high speed, such as fifty miles an hour (about 80 kph).

Primary inputs to the system are from sensors monitoring engine load conditions, preferably by monitoring engine intake manifold vacuum, such sensors being indicated at LV, HV1 and HV2. The low vacuum sensor LV senses when the engine is operating under high load conditions and, as hereafter disclosed, tends to enable selectable cylinders of the engine to enable the engine to better meet the high load condition. The ability to increase the operating number of cylinders to meet a high engine loading condition is desired during normal ongoing engine operation. It is also clearly desired following a cold start and before the engine has reached normal operating temperature to operate with all cylinders. Accordingly, the low vacuum sensing path at LV incorporates a suitable engine temperature sensing capability, as schematically indicated at 14.

An input unit 16 applies signals from the sensors 12, in suitable form, to a logic unit 18 having a bidirectional counting capability. An output unit 20 applies cylinder actuating or deactuating signals from the logic unit to actuators 22, assigned to several cylinders to be selectably disabled in a given engine. In the embodiment shown, four such actuators, labeled S1–S4, are shown as controlling four cylinders of an eight cylinder vehicle engine indicated at E. It will be understood that the controlled cylinders C1–C4 are here numbered merely for convenience in reference and that, in practice, the cylinders to be disabled and the order in which they are sequentially disabled will be chosen to maintain best engine balance. Also, while an eight cylinder engine has been illustrated at E, it will be understood that engines having a differing number of cylinders, as with the six cylinder engine generally indicated at E′, may also be controlled by the inventive apparatus. It will be further understood that while the embodiments disclosed are illustrated as valve selectors controlling four selector sets, for convenience in illustration, that the invention is readily adapted to control of more or fewer valve selectors, and hence cylinders, in a give engine.

Conveniently, the actuators 22 may each be a solenoid controlled valve selector arranged, in its cylinder deactuating mode, to hold closed the valve means of its corresponding engine cylinder, and in its cylinder enabling mode to permit normal operation of such valve means, and thereby control charge flow through the cylinder. While other types of actuator 22 may be employed at S1–S4, such a solenoid actuated intake valve selector is known from the commonly owned copending application of Martin W. Uitvlugt, Ser. No. 671,760 for "Improved Valve Disabler", filed Mar. 30, 1976. Preferably, both the intake and exhaust valves of a given cylinder are valve selector controlled, although control of merely the intake valve is also contemplated.

Figure 3:
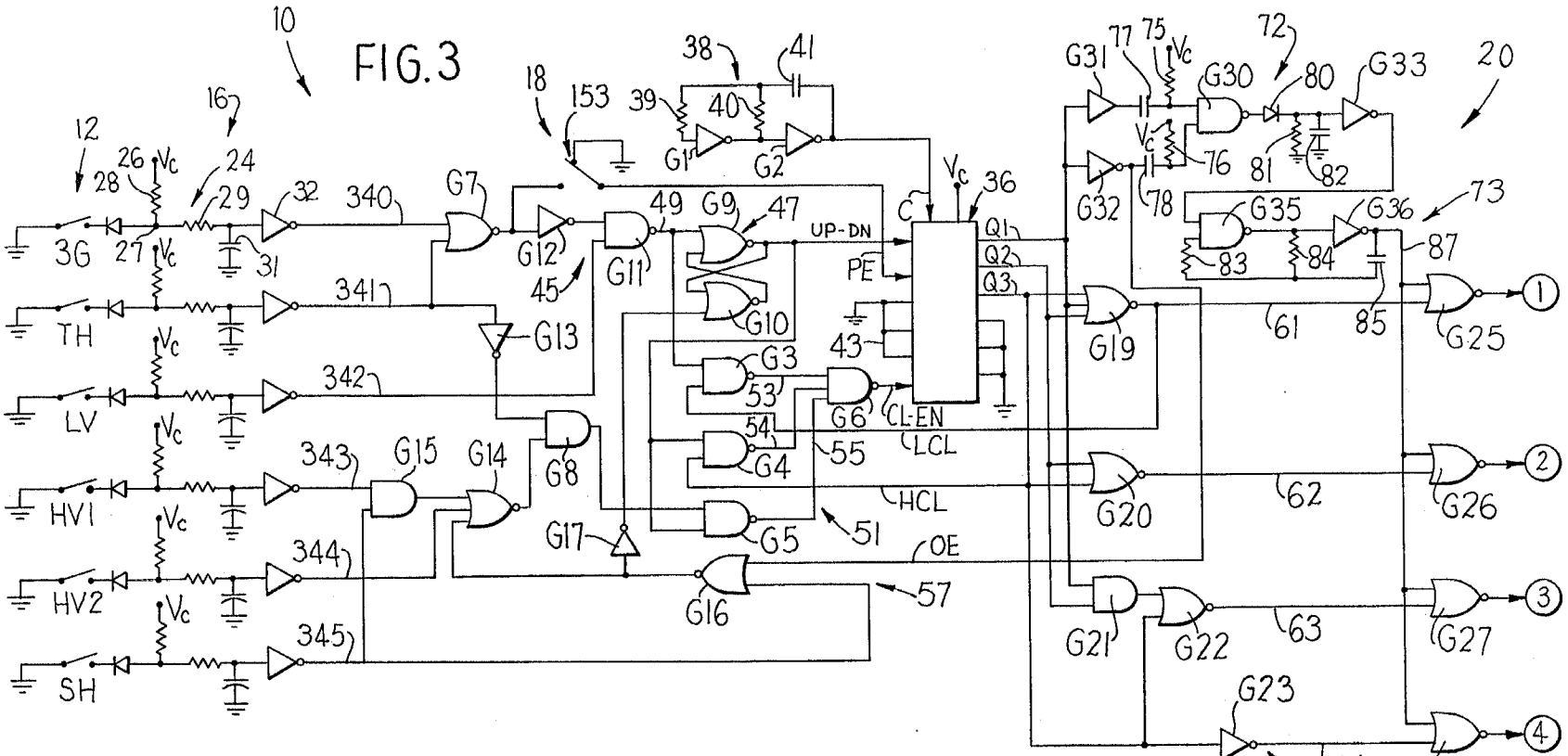
FIG. 3 is a circuit diagram corresponding to FIGS. 1 and 2.

In more detail, FIG. 3 illustrates sensors 12 comprising switches which signal the state of the corresponding parameter sensed by a switch closure to circuit ground. The switches 12 are shown at their open, or rest, position. Thus, closure of third gear switch 3G indicates the vehicle transmission is in top (normally third) gear. Alternately, sensor 3G may comprise a vehicle speed responsive switch closeable when the vehicle is above a relatively low set speed, e.g. 25 miles per hour (mph) (about 40 kph). Closure of the throttle position switch TH indicates that the engine throttle is closed (in idle or coast throttle position). Closure of high speed sensor switch SH indicate a vehicle speed exceeding a relatively high set speed, such as fifty mph (about 80 kph).

Low vacuum sensor switch LV, when open, indicates engine manifold vacuum below a relatively low set point, e.g. two inches (about 50 mm) of mercury, suggesting a high engine loading condition. Closure of high vacuum No. 1 sensor switch indicates engine manifold vacuum is above a higher set point, e.g. nine inches (about 230 mm) of mercury, for example as might persist in vehicle operation at highway cruising speeds in moderate terrain and with a permissible vehicle load. Closure of high vacuum No. 2 sensor switch indicates engine manifold vacuum above a somewhat higher set point, such as twelve inches (about 300 mm) of mercury, as might be found for example in flat terrain cruising at somewhat less than normal highway speeds.

It will be understood that various set points mentioned above, in terms of vacuum readings and engine or vehicle speeds, may be varied in a given instance to suit the needs of a given vehicle and the conditions under which it is to operate. The sensors 12 are preferably conventional and connect to and monitor the respective parameters of the engine and/or vehicle in a well known manner. Also, the types of parameters sensed and types of sensors employed, may vary depending on the particular application to which the engine is put, to best suit the needs of that application. For example, the vacuum switches 12 may be replaced by a transducer providing a continuous analog vacuum reading, for example to permit differing vacuum loads, dependent on the number of cylinders then operating, to be used for adding (or subtracting) a cylinder, such that one vacuum level would trigger a change from 6 to 5 cylinders but a different vacuum level would trigger a shift from 5 to 4 cylinders.

The input unit 16 includes a respective input circuit 24 for each of the sensor switches, to translate the open or closed condition of the respective sensor switch to a logic signal suitable to drive the logic unit 18. The input circuit 24 can be omitted if the switches 12 are replaced with input transducers having outputs suitable to drive the logic circuitry 18. The input circuits 24 are preferably identical and each includes a resistor 26 connected between a suitable positive operating potential supply indicated at $V_c$ and a junction point 27. The corresponding sensor switch, for example switch 3G, grounded at one side, connects at its other side (here through a diode 28) to the junction point 27, which in turn connects through a resistor 29 both to a grounded capacitor 31 and a Schmitt trigger 32 which provides a logic signal to drive the logic unit 18.

Thus, when any sensing switch 12 is open (as shown) junction point 27 is held high (at a logic 1) by potential source $V_c$. On the other hand, when the sensing switch 12 is closed, junction point 27 is clamped low (at circuit ground or a logic 0). Resistor 29 and capacitor 31 form a low pass filter for noise immunity. Schmitt trigger 32 provides additional noise immunity, particularly to eliminate false signals due to switch bounce. The Schmitt trigger also inverts, at its output, the logic state of the input 32. The diode 28 was provided as additional protection against transient noise but may be eliminated. Accordingly, the several sensor switches 3G, TH, LV, HV1, HV2 and SH when closed each provide a corresponding high potential, or logic 1, on a corresponding input line 340–345 to the logic unit 18.

The logic unit 18 here includes an up-down counter 36 having outputs Q1, Q2 and Q3 for controlling the number of engine cylinders in operation. The counter 36 is provided operating potential in a conventional manner as indicated at $V_c$. The clock pulse input C of the counter 36 is fed by a clock circuit 38, here comprising a two gate oscillator incorporating inverting amplifiers G1 and G2, resistors 39 and 40, and a capacitor 41. In the present embodiment the clock oscillator provides a square wave clock signal in the range 2.5 Hz to 15 KHz, preferably 10 Hz, to clock input C of counter 36.

Preferably, the system operates in a single mode, enabling and disabling cylinders sequentially in response to those input conditions requiring a change in the number of cylinders operating. Even under input condition C, in Table II below, such sequential enabling of cylinders is normally desirable, in that it minimizes drive line shock as additional cylinders become operative, yet it permits sufficiently rapid restoration of full engine operating displacement, as for acceleration from idle at a stop light.

Though less preferred, dual mode operation is contemplated wherein the system may instead under input condition C simultaneously enable all cylinders, though as in single mode, sequentially enabling and disabling cylinders under other input conditions. Such single and dual mode characteristics, under condition C, are illustrated by lines 151 and 152, respectively, in FIG. 2.

In FIG. 3, the preset enable input PE of the counter 36 is normally grounded (as here illustrated by a switch 153) so that counter 36 can only sequentially change its outputs Q1–Q3, providing the preferred single mode operation. Thus, the counter operates synchronously with a clock signal from clock 38.

A NOR gate G7, having inputs on lines 340 and 341 from the third gear and throttle position sensor switches 3G and TH, in turn drives a NAND gate G11 through an inverter G12, for sequential enabling of cylinders under condition C, in the preferred single mode of operation.

Logic unit 18 further includes up-down control circuitry generally indicated at 45 here including an up-down control latch 47 comprising NOR gates G9 and G10, interconnected, as shown, and having a set output line connected to the up-down input UP-DN of the counter 36. The NAND gate G11 has its output line 49 connected to the set input of latch gate G9, and its inputs respectively connected to low vacuum input line 342 and, as mentioned, through inverter G12 to the output of gate G7.

In FIG. 3, the dual mode is selected by shifting switch 153 from its position shown to connect the output of gate G7 to the preset enable input PE of the counter. The counter 36 has its preset inputs strapped to ground as indicated at 43 and the resulting logic 0 levels thereon are transferred direct to the Q1–Q3 outputs of the counter when the preset enable input PE is high (a logic 1) as under condition C, for asynchronous, or "jam", operation.

The logic unit further includes clocked mode enable logic circuitry 51 comprising a NAND gate G6 having its output connected to the clock enable input CL-EN of the counter 36. The inputs 53, 54 and 55 of NAND G6 are driven by further NAND gates G3, G4 and G5, respectively. The inputs of gate G3 are respectively provided from the output 49 of NAND G11 and from a low count limit line LCL hereafter discussed. The inputs of gate G4 are from the up-down control line UP-DN and from a high count limit line HCL which in this instance conveniently runs direct from the counter output Q3. The inputs of gate G5 are from mentioned line UP-DN and from an AND gate G8.

The inputs of gate G8 are through an inverter G13 from throttle position logic input line 341, and from a NOR gate G14. The inputs of NOR gate G14 connect, respectively, to the output of an AND gate G15, the high vacuum number 2 logic input line 344, and the output of a further NOR gate G16. Of these, the AND gate G15 connects to the high vacuum number 1 and high speed logic input lines 343 and 345 respectively.

NOR gate G16 constitutes a central part of an even number of cylinders logic circuit generally indicated at 57. The inputs to gate G16 are from the high speed logic input line 345 and from an odds-evens line OE hereafter discussed. In addition to its output connection to gate G14 above described, NOR gate G16 also drives, through an inverter G17, the reset input of latch 47 comprising gate G9 and G10.

The logic unit further includes decoder circuitry 59 for decoding the outputs Q1–Q3 of the counter 36 and providing a discrete output line for each of the engine cylinders to be controlled, such output lines being here indicated at 61–64 and offering control of four corresponding engine cylinders. The decoder includes a NOR gate G19 having respective inputs connected to each of the counter outputs Q1–Q3 and its output connected to a decoded line 61. Conveniently, the low count limit line LCL connects direct to the output of NAND G19 since the latter has a unique logic 1 output with the counter outputs Q1–Q3 at a logic 000.

The decoder further includes a NOR gate G20 having inputs from counter output lines Q2 and Q3 and its output connected to decoded line 62. In addition, an AND gate G21, with inputs from counter output terminals Q1 and Q2, drives one side of a NOR gate G22, the output of which connects to decoded line 63. Finally, the decoder 59 includes an inverter G23 which in common with the remaining input of NOR G22 connects to counter output Q3, and serves to connect the latter to decoded line 64.

Figure 3A:
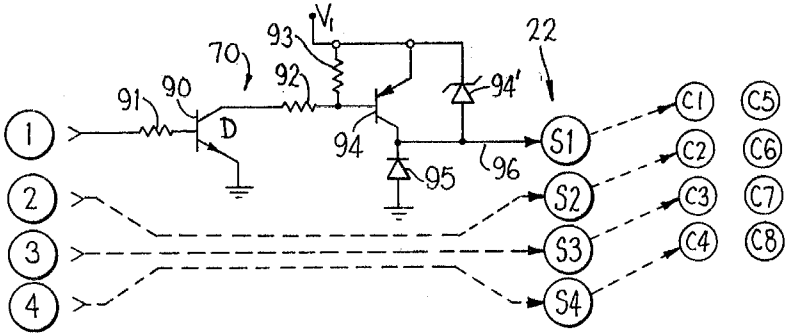
FIG. 3A is a circuit diagram illustrating a valve selector driver circuit for operatively connecting outputs of the FIG. 3 system to corresponding valve selector solenoids associated with several of the cylinders of a given multicylinder engine.

The output unit 20 here comprises a plurality of NOR gates G25–G28 with respective inputs connected to the decoded lines 61–64 and outputs controlling corresponding solenoid driver circuits, one of which is generally indicated at 70 in FIG. 3A, one thereof being provided for each cylinder to be controlled.

The output unit further includes a series path including a time delay circuit (for example a 1.5 second time delay) generally indicated at 72 connected in series with a duty cycle oscillator 73, from the Q1 (least significant) output of counter 36 to a common input of each of the output NOR gates G25–G28.

The delay circuit 72 comprises a NAND gate G30 having its inputs normally held high (at a logic 1) by connection through resistors 75 and 76 to the positive supply $V_c$. The two inputs of gate G30 connect through a series isolating amplifier G31 and capacitor 77, on the one hand, and a similar series inverter G32 and capacitor 78, to such least significant counter output line Q1. As seen in FIG. 3, output is taken from gate G30 through a diode 80, and a line connected by a parallel resistor and capacitor 81, 82 to ground, to an inverter G33, which in turn is connected to the enabling input of a NAND gate G35 comprising part of the duty cycle oscillator 73.

The duty cycle oscillator 73 here further comprises resistors 83 and 84, a capacitor 85 and an inverter G36, the latter being connected to the common input line 87 for the output gates G25–G28.

Thus, for each incremental change in the output of the counter 36 (upcount 1 or downcount 1) one, or the other, of isolation amplifier G31 or inverter G32, depending on the direction of voltage change on counter output Q1, will cause its corresponding capacitor 77 or 78 to charge through its corresponding resistor from the positive supply $V_c$, holding the corresponding input of AND gate G30 momentarily low. The result is a time delay, e.g. about a 1.5 second delay, during which a logic 0 at the output of the inverter G33, disables the duty cycle AND gate G35, interrupting the latter for the delay time (here 1.5 seconds). The oscillator 73 is normally free running and after timing out of the 1.5 second delay, again resumes production of a pulse train on the common input line 87 to the output gates G25–G28. On the other hand, during the 1.5 second time delay, the duty cycle oscillator 73 is disabled and continuously holds a logic 0 on common line 87, which enables each gate G25–G28, such that a logic 0 on the corresponding decode line 61–64, respectively, thereof will result in a disabling of the corresponding engine cylinder.

Thus, using conventional solenoid actuated valve selectors at 22, a cylinder is disabled by energizing such a selector 22 continuously for the delay time (here 1.5 seconds) to assure that its solenoid has pulled in. Said solenoid is then held in by the alternating duty cycle signal, which preferably is a 50 percent duty cycle signal.

FIG. 3A discloses an example of a suitable driver circuit interposable between each of the gates G25–G28 and its corresponding cylinder disabling device 22. In the embodiment shown, each driver circuit 70 comprises a Darlington transistor 90, here symbolized by a single transistor symbol, driven through a base resistor 91 from the corresponding output gate G25, and in turn driving, through a base resistor 92, a power transistor 94. The latter is equipped with a base pull-up resistor 93, which with its emitter, connects to a suitable positive voltage supply $V_1$. A collector-emitter Zener 94 and protective diode 95 from the collector to ground complete the circuit, output being taken from the collector of the driver transistor and applied at 96 to the corresponding transducer solenoid S1 which, when activated, disables the corresponding engine cylinder C1. The solenoid driver circuits for the remaining solenoid valve selectors S2–S4, associated with cylinders C2–C4, are similar.

OPERATION

It is believed that the foregoing description will make clear the operation of FIG. 3 and FIG. 3A apparatus, but same may be summarized below. The number of cylinders in operation at a given time is controlled by the output Q1–Q3 of the up-down counter 36, which outputs are decoded to disable engine cylinders (here in an eight-cylinder engine, for example) as follows:

TABLE I

| Q3 | Q2 | Q1 | Cylinders disabled | # of cylinders in operation |
|---|---|---|---|---|
| 0 | 0 | 0 | — | 8 |
| 0 | 0 | 1 | 1, | 7 |
| 0 | 1 | 0 | 1, 2 | 6 |
| 0 | 1 | 1 | 1, 2, 3 | 5 |
| 1 | 0 | 0 | 1, 2, 3, 4 | 4 |

As stated, the counter operates, in the preferred single mode, synchronously with a clock signal. Asynchronous operation, with the preset inputs (held at logic 0 at 43) transferred directly to the outputs Q1–Q3 is permitted in the dual mode, given the proper state of preset enable input PE of the counter 36.

Thus, when preset enable input PE is high (logic 1), the logic 0 on the grounded preset inputs at 43 are immediately and simultaneously transferred to counter outputs Q1–Q3.

On the other hand, when preset enable input PE is low (logic 0), the counter 36 operates synchronously with the clock 38, here running at 10 Hz. The counter output at Q1–Q3 is changed by one count on the positive edge of the clock signal at input C, provided the clock enable input CL-EN is held low (at a logic 0). More particularly, the output count at Q1–Q3 will be increased by one when the up-down input pin UP-DN is high, and on the other hand decreased by one when UP-DN is low.

Operating the counter synchronously with a 10 Hz clock allows a 0.1 second interval, after change in count, for input conditions as monitored by the sensors 12 to stabilize before the logic unit 20 makes a next decision to increase, decrease, or leave unchanged the number of operating cylinders. This minimizes any tendency for the logic unit to overshoot in its one-by-one increasing or decreasing of the operating number of cylinders, due to delays in the effect of each such cylinder disabling or enabling.

The state of clock enable input CL-EN of counter 36 is controlled by gates G3–G6. The counter will be disabled by these gates under the following conditions.

First, the counter will be disabled with the up-down count pin UP-DN high (upcount condition) and the counter output on pins Q3–Q1, respectively, at 100. More particularly, the logic 1 on counter output pin Q3 is applied through the high count limit line HCL to one input of gate G4 and the logic 1 on line UP-DN is applied to the other input of such gate. The resulting logic 0 output from gate G4 causes gate G6 to apply a disabling logic 1 to clock enable pin CL-EN of the counter 36. This prevents an overflow condition in the counter.

Second, the counter is also disabled with its up-down input pin UP-DN low (downcount condition) and its output on pins Q3–Q1, respectively, at 100. More particularly, the latter counter output is applied to NOR gate G19, resulting in a logic 1 output therefrom which is applied through the low count limit line LCL to an input of NAND gate G3. To select a downcount condition, the set input 49 of latch 47 is held high by gate G11 (as hereafter described), producing the resulting low on latch output line UP-DN. Such high, or logic 1, from line 49 is applied to the remaining input of NAND gate G3, which results in a logic 0 at its output, in turn causing gate G6 to apply a logic 1 to clock enable input CL-EN of the counter, disabling the latter. This prevents an underflow condition in the counter.

Third, the counter 36 will be disabled with its pin UP-DN high (in upcount condition) and the output of gate G5 low. As with gate G3 and G4, a logic 0 output on gate G5 results in a counter disabling logic 1 applied by gate G6 to the clock enable input CL-DN of the counter. To achieve this, gate G5 requires the logic 1 input not only from up-down count line UP-DN but also from gate G8. This condition of gate G8 is achieved as hereafter discussed in connection with conditions D and F in Table II below.

The following function table describes the conditions to change the number of engine cylinders in operation at any given time.

TABLE II

| | LV | TH | 3G | SH | HV1 | HV2 | Clock | Counter Output Q1 | Action |
|---|---|---|---|---|---|---|---|---|---|
| A | 1 | X | X | X | X | X | ⌠ | X | Add 1 cylinder |
| B | 0 | 0 | X | X | X | X | ⌠ | X | Drop 1 cylinder |
| C | 0 | 1 | 1 | X | X | X | X | X | Add 1 cylinder (or go to 8 cylinders) |
| D | 0 | 1 | 0 | 0 | 1 | 1 | X | X | No change |
| E | 0 | 1 | 0 | 0 | 0 | X | ⌠ | X | Drop 1 cylinder |
| F | 0 | 1 | 0 | 1 | X | 1 | X | 0 | No change |
| G | 0 | 1 | 0 | 1 | X | 1 | ⌠ | 1 | Drop 1 cylinder |
| H | 0 | 1 | 0 | 1 | X | 0 | ⌠ | X | Drop 1 cylinder |

X = Don't care

Figure 2:
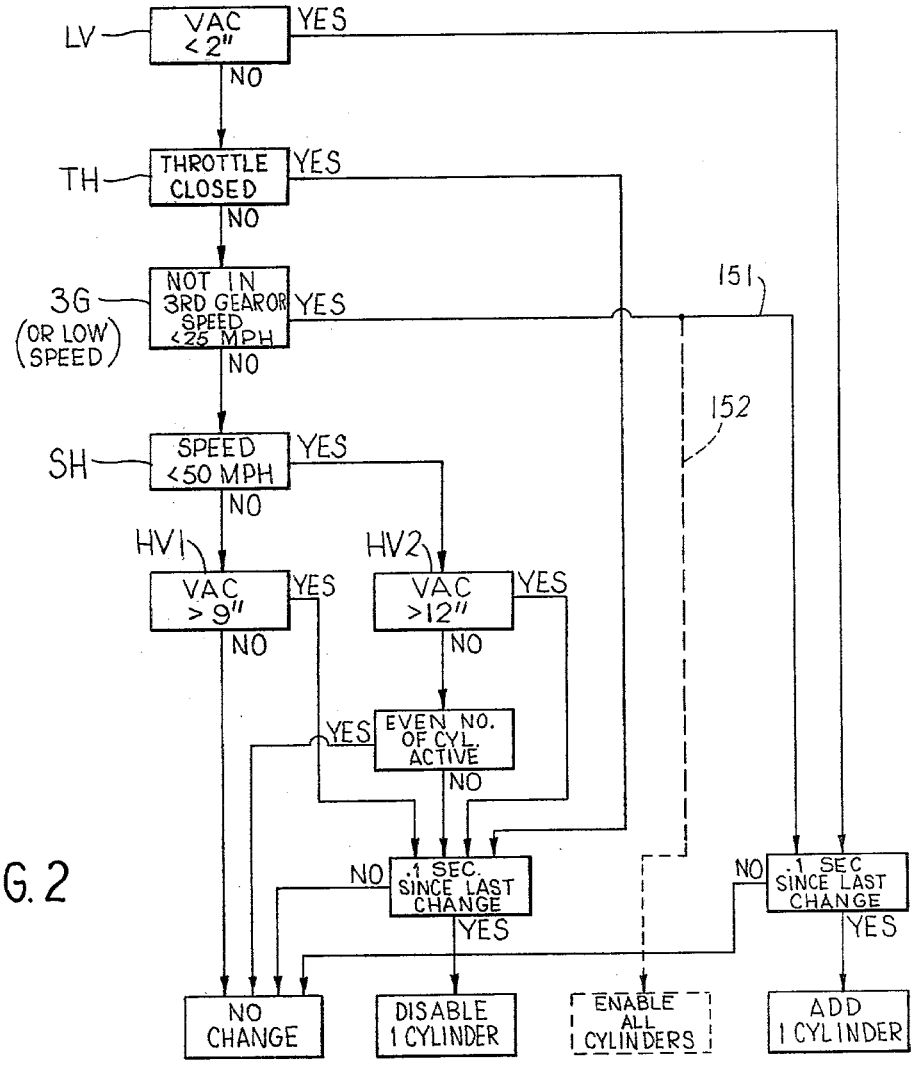
FIG. 2 is a flow chart indicating operation of the FIG. 1 embodiment.

The following description refers to Table II immediately above and also to the FIG. 2 flow chart.

Two of the indicated conditions require an increase in the number of operating cylinders, namely conditions C and A.

Condition C exists when the throttle is open and the vehicle transmission is not in top (here third) gear (or alternatively to the latter, when vehicle speed is below a low speed set point, such as 25 mph (about 40 kph)). Condition C comes in the into play, for example, where the vehicle has been at rest, as at a stop light, with the engine idling (or has been coasting at low speed with the throttle closed) and the throttle is now opened to accelerate the vehicle. Prior to opening of the throttle, the engine would normally be operating on only a minimum of cylinders (e.g. 4). In the preferred single mode (switch 153 grounded as shown), condition C adds operating cylinders sequentially, as in condition A discussed below, by producing a logic 1 output from gate G11. More particularly, with throttle sensor TH and top gear sensor (or low speed sensor) 3G both at logic 1, lines 340 and 341, and hence the inputs to gate G7, will both be a logic 0, providing the required logic 1 at the output of gate G7, and of gate G11.

Conversely, in dual mode, the preset enable input PE of counter 36 is forced high (to a logic 1) through switch 153 by the output of gate G7, causing the counter output Q1–Q3 to immediately go to a logic 000 condition, requiring full eight-cylinder operation of the engine, in a manner above discussed with respect to Table I and gates G19–G28. The connection of gate G7 with the preset enable line PE thus avoids a step-by-step increase in the number of operating cylinders, at 0.1 second per step in this example, as would otherwise be provided by normal clocked counting of the counter 36 upon opening of the throttle to accelerate the vehicle.

Condition A also requires an increase in the number of operating cylinders, and adds operating cylinders sequentially, as one at a time, unlike dual mode condition C. Under condition A, there is applied a logic 0 to input UP-DN of the counter, steering same in the downcount direction, and an enabling low on the clock enable input CL-EN of counter 36 for causing the counter to count down. Reaching a count of 000 on counter outputs Q1–Q3 causes gate G3 to disable the counter 36, as above discussed, to prevent an underflow condition therein.

In more detail, condition A involves a high engine load condition, corresponding to an engine manifold vacuum below the low set point LV, shown by opening of low vacuum switch LV. The vacuum switch LV thus provides a logic 1, inverted to a logic 0 applied to line 342 and causing a logic 1 to be applied by NAND gate G11 to set input 49 of latch 47, providing the needed logic 0 on counter input UP-DN for downcounting and hence for sequentially increasing the number of operative cylinders of the engine.

Under condition A (as well as conditions B, and D-H hereafter discussed) the counter 36 counts in a clocked manner since its clock enable input CL-EN is normally held at a logic 0 by NAND gate G6, requiring logic 1 outputs from each of NAND gates G3, G4 and G5. The latter three gates achieve logic 1 outputs if at least one input of each is held low. For gate G3 it suffices that counter steering input UP-DN be set for upcounting or that counter output Q1–Q3 be other than at their lowest count. For gate G4 it suffices that counter steering input UP-DN be set for downcounting or that the counter outputs Q1–Q3 be other than at maximum count. For gate G5 it suffices that counter steering input UP-DN be set to downcount or that the output of gate G8 be low.

Returning more specifically to system condition A of Table II, the high engine load condition reflected by sensor LV, if it persists, may continue to cause downcounting by counter 36 at the 0.1 second intervals set by clock 38, until such high load condition disappears (switch LV closes) or until the counter downcounts to its lower limit of 000. The latter changes the state of low count limit line LCL to a logic 1, switching gates G3 and G6 and turning off the counter with a gate G6 high output, to prevent counter underflow.

Attention is directed to Table II conditions B, E, G and H, all requiring a decrease in the number of operating cylinders. Occurrence of any of these four conditions will cause the counter steering input UP-DN to go high and the output of NAND G8 to go low, satisfying the clock enable condition on clock enable input CL-EN, all for upcounting by the counter 36. Assuming a condition B, E, G or H persists, upcounting continues until a count of 100 appears on counter outputs Q3–Q1, respectively, which through high count limit line HCL will cause gate G4 to disable the counter 36 to prevent an overflow therein. Such upcounting proceeds at the 0.2 second rate set by the clock 38 and sequentially decreases the number of operating cylinders of the engine.

It is believed the manner in which the sensors 12 operate the counter 36 under conditions B, E, G and H will be apparent from the above description and from the manner of interconnection of the gates operatively interposed, in FIG. 3, between sensors 12 and counter 36.

Taking condition B as an example, same may be taken to represent engine idle or vehicle coasting conditions wherein the throttle is substantially closed and manifold vacuum is at least above low vacuum set point LV. The logic 0 condition resulting from the corresponding closure of switches TH and LV appears as logic 1 conditions on lines 341 and 342. The logic 1 on line 341 insures a logic 0 at the output of gate G7. Thus, both inverter G12 and line 342 apply logic 1 signals to NAND G11 providing a logic 0 output therefrom and hence a logic 1, for upcounting, on steering input UP-DN of the counter. On the other hand, the logic 1 on line 341, inverted at G13, results in a logic 0 out of AND gate G8, holding gate G5 to its normal logic 1 output. Similar outputs on gates G3 and G4 cause gate G6 to hold the necessary logic 0 on clock enable input CL-EN of the clock 36 for clocked up counting unless gate G4 disables the counter in response to reaching of a count of 100 at outputs Q3–Q1.

For Table II conditions E, G and H, the outputs of gates G7 and G8, and hence the states of succeeding gates driven thereby, remain the same as in condition B above. However, the logic 0 output of gate G7 is provided through line 340 due to the "in third gear" condition sensed by switch 3G since the throttle is now open, causing sensor switch TH to lose control of the gate G7. Sensor TH similarly loses control of gate G8, the necessary logic 0 input to gate G8 being provided by gate G14 under conditions E, G and H. To provide the needed logic 0 output from gate G14 it suffices in condition E that sensors SH and HV1 provide logic 1 outputs (e.g. vehicle speed above 50 mph or about 40 kph and engine vacuum above 9 inches or about 230 mm of mercury). For condition H it suffices that manifold vacuum exceed the high set point HV2 (e.g. 12 inches or about 300 mm of mercury). For condition G it suffices that gate G16 provide the needed logic 1 output to gate G14, due to logic 0 input thereto corresponding to vehicle speed less than the set point SH (less than for example 50 mph or about 80 kph), and that an odd number of cylinders is presently disabled.

The basic operation of the above-discussed logic is to decrease the number of operating cylinders when the manifold vacuum is high, indicating a light load on the engine, and to increase the number of operating cylinders when the manifold vacuum is low, indicating heavy load on the engine. This operation is modified, as shown in function Table II, and above discussed, by a closed throttle, by low vehicle speed or by high vehicle speed.

For clarity, the influence of the high speed sensor SH may be further considered.

First, at speeds above the high speed set point (e.g. above 50 mph or about 80 kph), a high manifold vacuum (indicating a low engine load) is recognized as being the set point of sensor HV1 (which is set at a somewhat lower vacuum level than sensor HV2). In Table II, condition D calls for no change in the number of operating cylinders at such speeds above the high speed set point and with moderate manifold vacuum (between the set points of sensors LV and HV1). This is independent of the output of counter output Q1 (from which is sensed whether the number of cylinders operating is odd or even) and stable operation of the engine is allowed in 4, 5, 6, 7 or 8 cylinders.

Second, and in contrast, at speeds below the high speed set point sensed by sensor SH, a high manifold vacuum is recognized instead as being the set point of sensor HV2. Referring to Table II, condition F calls for no change in the number of operating cylinders only if counter output Q1 is low (i.e. the operating number of engine cylinders is even) thus allowing stable operation of the engine with only 4, 6 or 8 cylinders. When the number of cylinders is increased due to low vacuum condition, the latch 47, formed by the gates G9 and G10, maintains the direction of counting until an even number of cylinders are operating, even if the output line 340 of the low vacuum sensor LV goes low. Thus, the number of cylinders operating still changes one at a time but the engine operates on an odd number of cylinders only in the brief interval (e.g. 0.1 sec.) between steps.

In this way, reduced cylinder engine operation remains smoother at lower speeds by avoiding the relatively higher engine imbalance associated with five or seven cylinder operation of a conventional eight cylinder engine. On the other hand, such imbalance becomes substantially unnoticeable at higher speeds permitting high speed operation on five or seven cylinders, as well as on 4, 6 or 8 cylinders, with a conventional eight cylinder engine. In FIG. 3, gate G16 monitors both the high speed sensor SH and the odd-even cylinder count line OE (fed through inverter G32 from lowest significant count line Q1 of the counter 36). Such gate G16 is capable of stopping counting at an even number of cylinders, when required, by acting through the train of gates G14, G8, G5 and G6 on the clock enable input CL-EN of the counter 36. On the other hand, gate G16 acts to maintain count direction (when the number of cylinders is increased due to a low vacuum condition) by its output path through inverter G17 to the reset input of latch G9, G10.

To briefly review the counter output decoding logic generally indicated at 59 in FIG. 3, gates G19–G23 respond to the pin Q1–Q3 counter output conditions shown in table I to disable the indicated cylinders (or permit to remain in operation indicated numbered cylinders). In the embodiment shown, a logic 0 at the output of gate G19, G20, G22 and G23 suffices to disable corresponding ones of respective cylinders 1–4, the manner in which such gate provide such outputs in response to the corresponding counter outputs being apparent by inspection of the gate inputs in FIG. 3.

MODIFICATION

Figure 4:
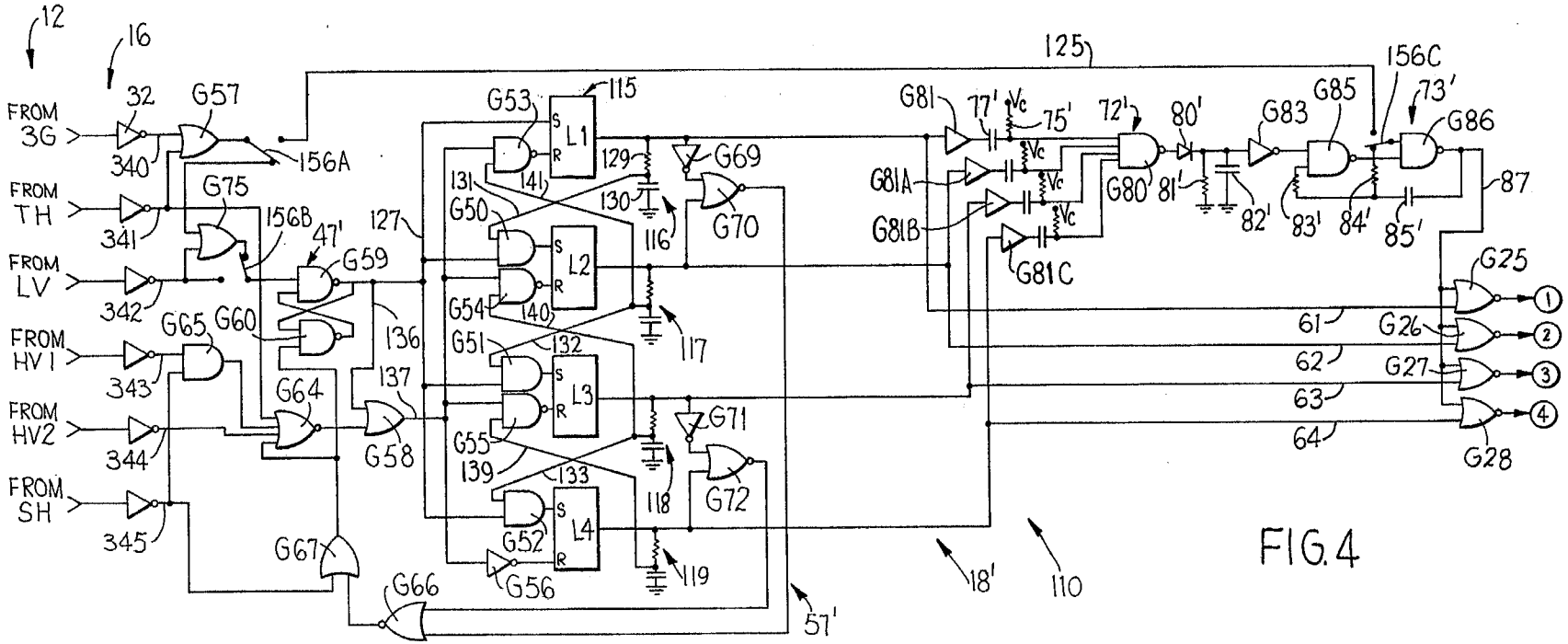
FIG. 4 is a circuit diagram similar to FIG. 3 but showing a modification.

FIG. 4 discloses a modified valve selector control system 110, which may use the same sensor array 12 and input unit 16, as well as the same output gates G25–G28 as the system 10 of FIG. 3. Accordingly, system 110 may employ the same solenoid driver circuits 70, transducers 22, and so forth, seen in FIG. 3, as are used with the FIG. 3 system 10.

The systems 10 and 110 differ primarily in their logic units 18 and 18', although the modified system 110 also operates to change the number of cylinders in accord with above discussed Table II and the FIG. 2 flow chart. For example, system 110 retains capability for enabling or disabling cylinders one at a time with a suitable pause between steps, going immediately to full engine operation (in dual mode), and providing for both continuous, and subsequent duty cycle, actuation of valve selector solenoids, as in system 10. System 110 further provides inherent protection against under or overflow in "counting".

The primary difference between the systems is that system 110 omits the counter 36, and instead employs a parallel array of RS latches L1–L4, corresponding in number to the number of cylinders disabled. While the use of clocked latches, for example D type latches, is contemplated, system 110 instead employs unclocked latches which nevertheless, by reason of corresponding RC time delay circuits 116–119, provide the desired pause (e.g. 0.1 seconds) between upward and downward steps in the number of cylinders selected. The array of latches L1–L4 is generally indicated at 115. Use in the system 110 of the latch array 115 advantageously eliminates the need for the decoder circuit 59 (latches G19–G23) of the system 10, inasmuch as the latch array 115 provides one output per cylinder to be disabled.

The input gating, interposed in between input line 340–345 and the latch array 115, and associated with the latter, differs in detail from the corresponding gating in system 110, but performs much the same general functions. By the same token, the delay circuit (e.g. 1.5 second) and duty cycle oscillator indicated generally at 72' and 73' perform substantially the function of circuit 72 and 73 of system 10 though differing somewhat in detailed structure therefrom.

In more detail, the latch array 115 includes, in the connection shown in FIG. 4, AND gates G50–G52 for controlling the set inputs S of latches L2–L4, respectively, and NAND gates and an inverter, indicated at G53–G56, controlling the reset inputs R of latches L1–L4, respectively. The logic unit 18' for system 110 further includes NAND gates G59 and G60 connected in a latch circuit 47' for controlling sequencing of the latches L1–L4 in a direction for enabling further cylinders. Further, a NOR G64, AND gate G65 and an OR gate G58 control sequencing of the latches in the opposite direction, for disabling cylinders. An even number of cylinders logic circuit, generally indicated at 57, comprises NOR gates G66 and G67 interconnected as shown with the inverters G69 and G71 and corresponding NOR gates G70 and G72. An OR gate G57, with an OR gate G75 and ganged switches 156A, B, C also allow enabling cylinders of the engine.

The solenoid turn-on timer 72', as with timer 72 of FIG. 3, includes a NAND gate G80 having plural inputs (one for each cylinder to be deactuated) connected to the positive voltage supply $V_c$ through a dropping resistor 75' and on the other hand connected through a capacitor 77' to the output of isolation amplifier G81. The corresponding isolation amplifiers for the several inputs of gate G80 are indicated at G81–G81C. As in system 10, the output portion of timer 72' includes diode 80', resistor 81', capacitor 82' and inverter G83, which when appropriate disable the duty cycle oscillator 73'. The latter, like oscillator 73 of system 10, includes NAND gate G85, resistors 83' and 84' and a capacitor 85'. However, in oscillator 73' a NAND gate G86 is employed as the output gate, controlling duty cycle line 87.

Considering the operation of system 110 of FIG. 4, condition C of Table II again arises with sensors 3G and TH showing non-third gear and throttle open conditions. The resulting gate G57 low output, in the preferred single mode shown, is passed by switch 156A and OR gate G75 to gate G59 to stepwise enable cylinders like under condition A below. The less preferred dual mode, wherein condition C triggers an immediate jump to all cylinders enabled, is selectable by switching ganged switches 156A, B, C from their positions shown. Then the mentioned low output from gate G57, through switch 156A and line 125 and switch 156C, drives the output of gate G86 and line 87 high, removing the drive to putput gates G25–G28.

Condition A requires incremental increasing of the number of operating cylinders. Particularly, a logic 1 (very low vacuum) output from low vacuum sensor LV places a logic 0 on line 342, which (directly or as switched through OR gate G75) requires NAND gate G59 to produce a logic 1 output. Such logic 1 is applied through a cylinder enable line 127 directed to the set input of RS latch L1 and to the set control gates G50–G52 of latches L2–L4. Accordingly, the output of latch L1 will be switched high (if it is not already at a logic 1) and a logic 1 therefore appears on corresponding output line 61, causing output gate G25 to display a logic 0 output and thereby call for enabling of engine cylinder number 1.

The set control gates G50–G52 require logic 1 signals from the preceding latch, as well as the logic 1 from gate G59, in order to actuate the set inputs S of latches L2–L4. The RC time delay circuits 116–119 each comprise a series resistor 129 and capacitor 130 connected from the corresponding latch output to ground, and serve a timing function comparable to the clock 38 of system 10. More particularly, when a latch, for example latch L1, has its output go high, the RC circuit 116 delays such logic 1 from appearing on input line 131 of the set control gate of the next latch in sequence, here set control gate G50 of latch L2. This delay (for example 0.1 seconds) allows for a possible change in the input conditions monitored by sensors 12 such that it may no longer be necessary to activate additional cylinders. Thus, where a condition may persist, holding line 127 at a logic 1, the mentioned setting of latch L1 acts through delay circuit 116, line 131 and gate G50 to set latch L2 after a brief delay. The resulting logic 1 at the output of latch L2 in turn acts through delay circuit 117, a line 132 and gate G51 to set latch L3 after a brief delay. The logic 1 at the output of latch L3 similarly acts through delay circuit 118, a line 133 and gate G52 to set latch L4 after a brief delay. Any of the set latches L1–L4 deliver a logic 1 through the corresponding output lines 61–64, causing corresponding gates G25–G28 to call for enabling of corresponding engine cylinders 1–4. On the other hand, removal of the condition A logic 1 on line 127 stops the above described sequential setting of latches L1–L4.

Conditions B, E, G and H require a decrease in the number of operating cylinders and such is accomplished by a reverse sequence resetting of the latches L1–L4, which is carried much as above described with respect to their sequential setting.

More particularly, under conditions B, E, G and H, the logic 0 provided by sensor LV, indicating a manifold vacuum above the low vacuum set point, removes the set input from up-down starting latch 47', permitting gate G67 to hold the latch 47' in a reset condition, as hereafter discussed, so as to hold low the cylinder enable (latch set) line 127. This permits resetting of the latches L1–L4 if necessary and is applied through a line 136 to OR gate G58 to enable same for resetting of the sequential latches. OR gate G58 thus enabled responds to the logic 0 at the output of gate G64 by providing a logic 0 on cylinder disable line 137, which through inverter G56 resets (if it is not already reset) latch L4. The logic 0 on line 137 also enables the reset control gates G53–G55. If the input condition persists, holding gate G58 as immediately above described, the latches will reset in the sequence L4, L3, L2 and L1, taken for example in 0.1 second steps, to disable cylinders 4, 3, 2 and 1 in that order. Thus, the logic 0 appearing at the output of latch L4 upon resetting thereof, is transferred by delay circuit 119, after a 0.2 second pause, through a line 139 to the input of gate G55, which then resets latch L3 providing a logic 0 at its output. Delay circuit 118 and a line 140, and then delay circuit 117 and a line 141, similarly act to reset latch L2 and then latch L1. The sequence of resetting can stop at any point, however, given a change in input conditions reversing the output of gate G58.

The logic 0 output of gate G64 required for resetting latches L1–L4 requires at least one logic 1 input to gate G64. Under condition B gate G64 receives the necessary logic 1 input due to the closed throttle condition sensed by sensor TH and the resulting logic 1 on line 341. For conditions E, G and H gates G65 and G67 supply the necessary logic 1 to gate G64 essentially as above described with respect to comparable gates G15 and G16 of FIG. 3.

The outputs of the latches L1–L4 require, as mentioned, no decoding since each latch controls one solenoid driver. The output states are as follows:

TABLE III

| L1 | L2 | L3 | L4 | Cylinder Disabled | # of Operating Cylinders |
|---|---|---|---|---|---|
| 1 | 1 | 1 | 1 | — | 8 |
| 1 | 1 | 1 | 0 | 4 | 7 |
| 1 | 1 | 0 | 0 | 4, 3 | 6 |
| 1 | 0 | 0 | 0 | 4, 3, 2 | 5 |
| 0 | 0 | 0 | 0 | 4, 3, 2, 1 | 4 |

To insure stable operation in an even number of cylinders only below the high speed set point (e.g. 50 mph or about 80 kph), gates G71 and G72 decode a one cylinder disabled condition and gates G69 and G70 decode a three cylinders disabled condition, by sensing the outputs of latches L3, L4 and latches L, L2, respectively. A logic 1 output from gate G70 or G72 accompanied by vehicle speed less than the high speed set point (e.g. 50 mph or about 80 kph) reflected by a logic 0 on line 345, require a logic 1 to appear at the output of gate G67, causing a low at the output of gate G64 and thus on cylinder disable line 137, causing one more of the latches L1–L4 to be reset and hence providing engine operation with an even number of cylinders for better engine balance and reduced vibration, below 50 mph (or about 80 kph). Note that in so doing, the logic 1 output of gate G67 is also applied to the reset input of latch 47' (at gate G60) and positively assures, if this is not already the case, that the latch 47' output on lines 127 and 136 is a logic 0, disabling cylinder enable line 127 and enabling with the necessary logic 0 the gate G58, permitting it to cause sequential resetting of the latches L1–L4. Thus, similarity of function of up count direction steering latches 47 and 47' may be noted. Gate G67 avoids simultaneous enabling and disabling of cylinders.

Resetting of any latch L1–L4 applies a corresponding logic 0 to its respective output lines 61–64 rendering corresponding gates G25–G28 responsive to line 87 which then dictates whether or not the corresponding cylinder is to be disabled. On the other hand, the occurrence of the logic 0, marking resetting of such a latch L1–L4, drops input potential to corresponding isolation amplifier G81–G81C, providing a corresponding logic 0 to NAND gate G80, switching its output high for a period determined by the RC time constants at 75', 77' and 81', 82' (e.g. 1.5 seconds) and thereby causing the duty cycle oscillator 73' to provide a continuous, rather than oscillatory cylinder disabling signal on line 87. The corresponding gate G25–G28 thus continuously drives its corresponding output solenoid for about 1.5 seconds, assuring tht it is switched on to disable its corresponding cylinder, whereafter duty cycle oscillation at 73' resumes, supplying sufficient energy to the activated solenoid to hold same on, much in the manner described above with respect to circuits 72 and 73 of FIG. 3.

While nonclocked RS latches are suggested above in connection with system 110, D type latches could be used instead and it would also be possible to run the system employing a clock instead of RC time delays (at 116–119).

The above-discussed one at a time sequential enabling or disabling of cylinders under this invention aids fuel economy without sacrifice of driveability and smoothness and particularly minimizes the driveline shock, and unpleasant mechanical jarring of vehicle parts engaging the driver and passengers that can result from simultaneous enabling or disabling of several cylinders.

It is contemplated that the present invention may be embodied in, though not limited to, forms including discrete transistor circuitry, modules such as with the latches and gates of FIG. 4, an integrated circuit such as with the counter 36 of FIG. 3, or a microprocessor appropriately programmed according to FIG. 2.

While the above discussion refers both to engine and vehicle (or road) speeds (as with inputs SH and optionally 3G), engine speed is the critical speed and is preferably the speed actually monitored.

Although particular preferred embodiments of the invention have been disclosed in detail for illustrative purposes, it will be recognized that variations or modifications of the disclosed apparatus, including the rearrangement of parts, will lie within the scope of the present invention.

The embodiments of the invention in which an exclusive property or privilege is claimed are defined as follows:

1. A system for optimizing the number of combustion chambers to be operating in an internal combustion engine having a number N of combustion chambers and air or air-fuel mixture valves and combustion product exhaust valves for controlling charge flow to and from each of said chambers, said system comprising:

means actuable for alternatively enabling and disabling at least one of the air or air-fuel mixture valve and combustion products exhaust valve of selected chambers of said engine while the engine is operating;

input means responsive to changes in specified engine operating load parameters for providing differing input signals;

logic means operatively connected to said valve enabling and disabling means for alternatively selecting between at least three different numbers N, N1 and N2 of chambers to be operating, where N is greater than N1 and N1 is greater than N2, said logic means being operatively responsive to certain changes in said input signals for stepwise increasing and decreasing said number of engine chambers having valves disabled, and thereby optimizing in response to changes in operating load condition the number of chambers through which charge flow is permitted.

2. The apparatus of claim 1 wherein said logic means includes bidirectional counting means capable of counting the maximum number of chambers to be disabled, and means responsive to said input signals for controlling the direction of counting in said bidirectional counting means, said bidirectional counting means having plural output terminals and applying thereto a pattern of signals indicating the count.

3. The apparatus of claim 2 in which said logic means includes means operatively associated with said bidirectional counting means for introducing a time delay between successive counts of said bidirectional counting means, so as to permit corresponding enabling or disabling of the chamber by said enabling and disabling means and stabilization of engine operating parameters in response thereto, such that said logic means can assess whether an additional chamber is to be enabled or disabled.

4. The apparatus of claim 3 in which said means for introducing said time delay comprises a free running clock circuit having its output connected to said bidirectional counting means for limiting the counting speed of the latter to the clock frequency.

5. The apparatus of claim 4 wherein the bidirectional counting means is a bidirectional counter unit.

6. The apparatus of claim 3 wherein said bidirectional counting means comprises plural latches operable in sequence both for up-counting and down-counting.

7. The apparatus of claim 6 including time delay units connecting the outputs of ones of said latches to enabling inputs of adjacent ones of said latches, such that a change in state of a given said latch enables a change in state of the next latch in the up-counting or down-counting sequence only after timing out of said time delay unit of said given latch.

8. The apparatus of claim 2 in which the bidirectional counting means comprises a bidirectional counter having plural output pins actuable in a plurality of differing patterns each uniquely encoding a different number of chambers to be disabled.

9. The apparatus of claim 8 in which said bidirectional counting means further includes decoding logic means responsive to signals of said output pins of said bidirectional counter and in turn having a plurality of decoding output pins each uniquely corresponding to a respective said pattern of actuation of said counter output pins, there being one said enabling and disabling means for each of said chambers to be enabled and disabled, each said enabling and disabling means being in driven connection with its own one of said decoding output pins.

10. The apparatus of claim 1 in which said enabling and disabling means comprise a plurality of output gates, each corresponding to a respective said chamber to be enabled and disabled, the output of each gate determining the enabled-disabled condition of its corresponding combustion chamber, a gate drive means commonly connected to a first input of each of said output gates, said output gates having second inputs operatively connected in an individual manner to said logic means for determining which of said gates is to disable its corresponding chamber, given the appropriate gate drive signal commonly applied to said gate first input.

11. The apparatus of claim 10 in which said gate drive means comprises duty cycle oscillator means for actuating said output gate first input each in a repetitive on-off manner, said enabling and disabling means further including solenoid means respectively driven by said output gates for disabling corresponding combustion chambers, said on-off duty cycle being of on-off duration sufficient for maintaining a given said solenoid energized, while minimizing heating thereof, and including timing means actuable in response to a change in the output condition of said logic means for eliminating the off condition of said duty cycle oscillator means for an initial duration sufficient to insure complete turn-on of a given solenoid.

12. The apparatus of claim 1 in which said input means include means responsive to engine load for alternatively producing high-load and low-load input signals indicative of relatively heavy or relatively light loading on said engine, said logic means including means responsive to said low-load input signal for permitting disabling of a then operating combustion chamber.

13. The apparatus of claim 12 in which said input means includes means responsive to a further operating parameter for producing a further said input signal having at least two values representative of at least two states of such parameter, said logic means including means operatively connected to said low load input signal responsive means and responsive to one of said values of said further input signal for blocking said disabling of said then operating chamber, such that such chamber continues to operate despite the presence of said low load input signal.

14. The apparatus of claim 13 in which said engine is a vehicle engine and said means responsive to a further operating parameter includes at least one of an engine throttle position sensor, a vehicle speed sensor, a vehicle transmission gear selector sensor, and an engine intake manifold vacuum sensor.

15. The apparatus of claim 12 in which said engine is a vehicle engine and said input means further includes means responsive to operating conditions combining engine throttle open, vehicle speed above a high set point corresponding to a moderate highway cruising speed, and engine manifold vacuum below an intermediate set point to indicate more than moderate engine loading, for providing a corresponding further set of input signals, said logic means including means responsive to said further set of input signals for blocking disabling of any further combustion chambers.

16. The apparatus of claim 12 in which said input means further includes means additionally responsive to an engine throttle closed condition, corresponding to idling and coasting conditions, for providing a corresponding input signal, said logic means including means responsive to said low load input signal and engine throttle closed input signal for causing said output means to disable another combustion chamber.

17. The apparatus of claim 12 in which said engine is a vehicle engine and said input means further includes means individually responsive to an engine throttle open condition and placement of the vehicle transmission in top gear for providing corresponding input signals, said logic means being responsive to these input signals for further permitting disabling of a then operating combustion chamber.

18. The apparatus of claim 17 in which said input means includes means for signalling a vehicle speed above a set point corresponding to a moderate vehicle cruising speed and an engine manifold vacuum above an intermediate set point corresponding to only a moderate engine load, said logic means including means responsive to such signalling for causing said enabling and disabling means to disable an operating combustion chamber.

19. The apparatus of claim 17 in which said input means includes means for signalling a speed below a set cruising speed and means for signalling an engine manifold vacuum above or below a high set point corresponding to a low engine load, said logic means being responsive to said signalling for permitting disabling of another operating combustion chamber and particularly for causing said output means to disable such another operating chamber in response to signal indication of engine manifold vacuum above said high set point, said logic means including means for detecting that an odd number of combustion chambers remains enabled and means responsive to such detection for causing said output means to disable a further combustion chamber, so as to leave an even number of combustion chambers operating for reduced engine vibration below said cruising speed.

20. The apparatus of claim 12 in which said engine is a vehicle engine and said input means includes additional means for signalling an engine open throttle condition and the presence of the vehicle transmission in other than top gear, said logic means including means responsive to said signalling to cause said enabling and disabling means to immediately enable all engine combustion chambers.

21. The apparatus of claim 1 in which said input means includes means responsive to a high engine load condition for providing a high engine load signal, said logic means including means responsive to said high engine load signal for causing said enabling and disabling means to eliminate a disabled condition on a combustion chamber so as to increase the operating number of combustion chambers.

22. In a valve system for an internal combustion engine of the kind having multiple combustion chambers, the combination comprising:

an air-mixture intake valve openable to flow air or air-fuel mixture into each combustion chamber and a combustion products exhaust valve openable to flow combustion products out of each combustion chamber;

a limiting means connected to at least one of said air-mixture intake valve and products exhaust valve of a given combustion chamber and actuable during engine operation for limiting opening thereof, there being a said limiting means for each of at least one of said intake and exhaust valves of each of at least three combustion chambers of said engine;

input means responsive to changes in specified engine load conditions for providing different input signals;

sequencing means operatively connected to control said limiting means and responsive to occurrence of one pattern of input signals for limiting opening of at least one of said intake and exhaust valves of at least one operating combustion chamber and thereafter responsive at least to continuance of said one pattern for limiting opening of at least one of said intake and exhaust valves of at least one further operating combustion chamber, there being at least one intermediate number of combustion chambers having said valve limiting means between zero and the maximum number of combustion chambers having said valve limiting means;

whereby to permit incremental reduction in effective operating displacement of the engine under certain engine load conditions.

23. The apparatus of claim 22, in which said sequencing means includes means responsive to continuation of a still further input signal pattern for deactuating the intake and exhaust valve limiting means of combustion chambers one after another.

24. A system for optimizing the number of operating combustion chambers in an engine of the kind having multiple combustion chambers each including an air-mixture intake valve openable to flow air alone or an air and fuel mixture into said combustion chamber and a combustion products exhaust valve openable to flow combustion products out of said combustion chamber, said system comprising:

a limiting means actuable during engine operation for limiting opening of at least one of said air-mixture intake valve and products exhaust valve of a corresponding combustion chamber, there being a said limiting means for each of at least three combustion chambers of said engine;

input means responsive to changes in specified engine load conditions for providing different input signals;

sequencing means operatively connected to the several said limiting means and responsive to occurrence of one pattern of input signals for changing the number of limited ones of said air-mix inlet valves and exhaust valves progressively from a first number to a second number to a third number, said second number being between said first and third numbers;

to thereby permit incremental reduction in effective operating displacement of the engine under certain engine load conditions.

* * * * *

UNITED STATES PATENT OFFICE

CERTIFICATE OF CORRECTION

Patent No. 4 227 505 Dated October 14, 1980

Inventor(s) Gerald L. Larson et al

It is certified that error appears in the above-identified patent and that said Letters Patent are hereby corrected as shown below:

Column 3, line 64; change "give" to ---given---.

Column 8, line 68; change "100" to ---000---.

Column 12, line 66; change "provide" to ---provides---.

Column 14, line 25; change "putput" to ---output---.

Column 16, line 30; change "tht" to ---that---.

Column 17, lines 54-55; change "enableing" to ---enabling---.

Signed and Sealed this

Third Day of February 1981

[SEAL]

Attest:

RENE D. TEGTMEYER

Attesting Officer

Acting Commissioner of Patents and Trademarks